US006741229B1

(12) United States Patent
Yanagi et al.

(10) Patent No.: US 6,741,229 B1
(45) Date of Patent: May 25, 2004

(54) DISPLAY DEVICE AND METHOD FOR DRIVING THE SAME

(75) Inventors: Toshihiro Yanagi, Nara (JP); Takafumi Kawaguchi, Mie (JP)

(73) Assignee: Sharp Kabushiki Kaisha, Osaka (JP)

( * ) Notice: Subject to any disclaimer, the term of this patent is extended or adjusted under 35 U.S.C. 154(b) by 153 days.

(21) Appl. No.: 09/611,382

(22) Filed: Jul. 7, 2000

(30) Foreign Application Priority Data

Jul. 9, 1999 (JP) ..... 11-196709
May 30, 2000 (JP) ..... 2000-161257

(51) Int. Cl.[7] ..... G09G 3/36
(52) U.S. Cl. ..... 345/98; 345/94; 345/99
(58) Field of Search ..... 345/87, 90, 93, 345/94, 96, 98, 99, 100, 208, 213

(56) References Cited

U.S. PATENT DOCUMENTS

| | | | | |
|---|---|---|---|---|
| 4,701,025 A | | 10/1987 | Endo et al. | |
| 5,537,128 A | | 7/1996 | Keene et al. | |
| 5,736,972 A | * | 4/1998 | Kitagishi et al. | 345/99 |
| 5,912,651 A | * | 6/1999 | Bitzakidis et al. | |
| 5,940,061 A | | 8/1999 | Sato | |
| 6,014,126 A | * | 1/2000 | Nishihara | |
| 6,078,304 A | * | 6/2000 | Miyazawa | 345/89 |

FOREIGN PATENT DOCUMENTS

| | | | |
|---|---|---|---|
| EP | 0 487 140 | | 5/1992 |
| EP | 0 552 886 | | 7/1993 |
| EP | 1 061 499 | | 12/2000 |
| JP | 07-036413 | * | 2/1995 |
| JP | 07-334141 | * | 12/1995 |
| JP | 08-234161 | * | 9/1996 |
| JP | 9-265073 | | 10/1997 |
| WO | WO 95/01701 | | 1/1995 |

OTHER PUBLICATIONS

N. Matsuhashi, et al, Japanese Publication for Opposition No. 2 –28873, Published for Opposition on Jun. 26, 1990 and English abstract thereof.

T. Kurita, "Display System for Hold Type Display and Image Quality of Moving Pictures", Japanese Liquid Crystal Society First LCD Forum, Aug. 28, 1998.

* cited by examiner

*Primary Examiner*—Regina Liang
(74) *Attorney, Agent, or Firm*—David G. Conlin; Steven M. Jensen; Edwards & Angell, LLP

(57) ABSTRACT

A device for displaying a video signal which is supplied to the device along with a vertical synchronizing signal, includes a plurality of pixels arranged in a matrix, a switching element connected to each of the plurality of pixels, and a driving circuit for writing the video signal into each of the plurality of pixels via the switching element. The driving circuit writes the video signal to each of the plurality of pixels with a cycle TW1 shorter than one cycle of the vertical synchronizing signal.

16 Claims, 15 Drawing Sheets

DISPLAY DEVICE AND METHOD FOR DRIVING THE SAME

BACKGROUND OF THE INVENTION

1. Field of the Invention

The present Invention relates to a display device and a method for driving the same. More particularly, the present invention relates to a display device including a thin film transistor (hereinafter referred to as TFT) as a switching element for each pixel, such as an active matrix liquid crystal display device, and a method for driving the same.

2. Description of the Related Art

Conventionally, liquid crystal display (hereinafter referred to as LCD) devices have been widely used for televisions, graphic displays, etc. Of the LCD devices, an active matrix LCD device has an excellent display image without crosstalk between adjacent pixels even when the number of pixels is increased. For this reason, the active matrix LCD device has been widely used as a display for digital systems such as a computer.

Such an active matrix LCD device includes an LCD panel 10 and a driving circuit 356, for example, as shown in FIG. 11.

The LCD panel 10 includes a pair of electrode substrates having a liquid crystal material therebetween. A polarizer is attached on the outer surface of each electrode substrate. One of the electrode substrates is a TFT array substrate. The other electrode substrate is a counter substrate.

The TFT array substrate is made of a transparent, insulative substrate such as glass. On the TFT array substrate, a plurality of signal lines S(1), S(2), . . . , S(i), . . . , S(N), and a plurality of scanning lines G(1), G(2), . . . , G(j), . . . , G(M) are provided in a matrix. A switching element 102, such as TFT, is provided at each intersection of a signal line 201 and a scanning line 301. The switching element 102 is connected to a pixel electrode 103. An alignment film is provided on substantially an entire surface of the TFT array substrate, covering those lines and elements.

The counter substrate is made of a transparent, insulative substrate such as glass, as is the TFT array substrate. A counter electrode 105 and an alignment film are successively provided on an entire surface of the counter substrate. A display cell (pixel) 1 is a portion of a liquid crystal layer sandwiched between the pixel electrode 103 and the counter electrode 105. A matrix of such pixels is provided in the LCD panel 10.

The driving circuit 356 includes a write circuit 250 and a timing control circuit 400. The write circuit 250 includes a scanning line driving circuit 300 connected to the scanning lines 301, a signal line driving circuit 200 connected to the signal lines 201, and a counter electrode driving circuit (not shown) connected to the counter electrodes 105. The timing control circuit 400 is connected to the signal line driving circuit 200 and the scanning line driving circuit 300.

The scanning line driving circuit (gate driver) 300, for example, includes a shift register and a select switch. The shift register includes M flip-flops in cascade connection. The select switch is switched in response to an output from each flip-flop. A gate scanning voltage Vgh, which is sufficient to switch the TFT 102 to the ON state, or a gate holding voltage Vg1, which is sufficient to switch the TFT 102 to the OFF state, is input to the scanning line driving circuit 300. The voltage Vgh or Vg1 is successively propagated through the flip-flops while being output from the respective select switches. In response to the voltage Vgh, the select switch outputs the voltage Vgh to the scanning line 301 in a scanning period of time (TH) to switch the TFT 102 to the ON state. In response to the voltage Vg1, the select switch outputs the voltage Vg1 to the scanning line 301 to switch the TFT 102 to the OFF state. Timing of the output is controlled by the timing control circuit 400.

Such an operation writes into a display cell (pixel) 1 a video signal output onto the TFT via the signal line 201 from the signal line driving circuit 200.

In this way, the video signal is written into the pixel 1 via the TFT 102 in the scanning period of time (which is typically equal to a horizontal synchronization period, e.g., several tens of micro seconds). Thereafter, the voltage is held in the pixel 1 until a next write operation starts, i.e., a vertical synchronization period (a frame period). This allows the video signal to be displayed on the display device.

Recently, LCD devices have been commonly used for displaying not only still pictures but also moving pictures, owing to high-performance computers, etc. Further, large-size liquid crystal televisions have come into practice. Accordingly, high-quality display performance is required for the LCD devices.

Unfortunately, conventional LCD devices do not have satisfactory display performance for moving pictures.

For example, consider the following case. Referring to FIG. 12A, a white quadrangle is displayed in the black background, and the quadrangle is moved from the left to the right. In the conventional LCD devices. the contour of the moving quadrangle is blurred as shown in FIG. 12B.

This is caused because the conventional LCD devices have a response time of as great as 50 ms. Such devices are not suitable for visual devices dealing mainly with moving pictures, since the moving pictures have unclear contours, resulting in poor picture quality.

Picture quality may be evaluated on the following two scales: (1) a transit response time which is a period of time during which a display changes from white to black or from black to white, i.e., a change in luminance from 10% to 90% or 90% to 10%; and (2) a human perceptive response time which is a period of time during which a human perceives a change in a luminance level from 0% to 100% or 100% to 0%. For display devices exhibiting moving pictures, although the transit response time (1) is conventionally used, the human perceptive response time has more important meaning. The reason is that even when the luminance level is changed from 10% to 90% in a short time, if it takes a long time to change 90% to 100%, the blurred contour of a moving picture in perceived as shown in FIG. 12B.

For convenience of explanation, a response time which it takes for a human to perceive a change in a luminance level from 0% to 100% or 100% to 0% is defined as Td_LCD (black display to white display) or Tr_LCD (white display to black display), respectively. When Tr_LCD is not conditionally separated from Td_LCD, the change in a luminance level is defined as T_LCD (from black display to white display or from white display to black display). The response time of a display device which is required for non-blurred moving picture display is not strictly defined, since it significantly varies depending on the size of a moving picture and the background or among individuals. In the present invention, it is assumed that a moving picture response limit time Tmov is equal to about 20 ms. The moving picture response limit time Tmov is applied to the case of the luminance change from black display to white display as well an the case of the luminance change from white display to black display.

The response time of a liquid crystal material used in the above-described LCD device is defined on the following scales: (1) Tr_LC which is a period of time which is it takes a liquid crystal molecule to change the orientation toward the vertical direction due to an applied electric field; and (2) Td_LC which is a period of time which it takes a liquid crystal molecule to return to the original state due to an intermolecular force in the absence of an applied electric field. Tr_LC and Td_LC are given by $$Tr_LC=\eta d^2/\{(|\in p-\in s|)V-K\pi_2\} \quad (1)$$

$$Td_LC=\eta d^2/K\pi^2 \quad (2)$$

where K=K1+(K3−2×K2)/4 where K1, K2, and K3 are the divergent, torsional, and flexural elastic coefficients of the liquid crystal material, respectively; ∈s is the dielectric constant in the major axis direction of a liquid crystal molecule; ∈p is the dielectric constant in the minor axis direction of a liquid crystal molecule; η is the tortional viscosity of a liquid crystal molecule; d is the thickness of a liquid crystal display cell (cell gap); and V is the applied voltage.

Liquid crystal materials themselves have been improved so that Tr_LC is substantially equal to Td_LC and Tr_LC and Td_LC can be achieved to be as small as 5 ms. This response speed is sufficiently fast as compared with the above-described moving picture response limit time Tmov (=20 ms). Despite such a fast response speed of the liquid crystal material itself, the display response time (Tr_LCD) of an LCD device is as long as 50 ms. The reason will be described below.

FIGS. 13A and 13B are diagrams illustrating a liquid crystal display cell. FIG. 13A shows a white display state of the cell in the presence of an applied voltage having a white level. FIG. 13B shows a black display state of the call in the presence of an applied voltage having a black level.

The liquid crystal display cell of the LCD device displays a video signal when a voltage is applied across the cell so that the alignment of liquid crystal molecules therein is changed. The liquid crystal molecule has a dielectric anisotropy property (the dielectric constant ∈s in the major axis direction is different from the dielectric constant ∈p in the minor axis direction). For this reason, the capacitance of the LCD cell varies depending on an applied voltage. The capacitance Clc (white) of the LCD cell upon the white display and the capacitance Clc (black) of the LCD cell upon the black display are given by $$Clc(white)=\{(\in 0\times\in sw)/d\}\times S \quad (3)$$

$$Clc(black)=\{(\in 0\times\in pb)/d\}\times S \quad (4)$$

where ∈sw is the relative dielectric constant upon the white display, i.e., in the presence of a white level voltage; ∈pb is the relative dielectric constant upon the black display, i.e., in the presence of a black level voltage; ∈0 is the vacuum dielectric constant; S is the electrode area of the LCD cell; and d is the distance between the electrodes (cell gap).

FIG. 14 shows a voltage-dependent capacitance characteristic of the LCD cell where the capacitance of the LCD cell upon the white display, i.e., in the presence of a white level voltage is defined as 1. Since ∈sw<∈pb is established, the capacitance of the LCD cell upon the black display is larger than the capacitance of the LCD cell upon the white display, as shown in FIG. 14. The ratio is about two to one, depending on what material is used.

FIG. 15 is a diagram showing the relationship between a voltage change and a display response time (Tr_LCD2) with respect to an arbitrary LCD cell of an LCD device when the white display is switched to the black display. The liquid crystal is typically driven by an alternating current from a reliability point of view. Accordingly, a holding voltage of the LCD cell should be driven in such a way to change the polarity of the holding voltage in the frame-by-frame basis. For sake of simplicity, a waveform obtained by driving the liquid crystal by a direct current is herein illustrated.

A synchronizing signal is supplied to the display device along with a video signal. A vertical synchronizing signal which determines one frame cycle is included in the synchronizing signal. A scanning line voltage is a scanning signal output onto the scanning line G(j) from the scanning driving circuit 300 (FIG. 11). A signal line applied voltage is a video signal output onto the signal line S(i) from the signal line driving circuit 200. The LCD cell holding voltage is shown by a voltage waveform of one LCD cell provided at the intersection of the scanning line G(j) and the signal line S(i).

During time periods T1 and T2, a white level voltage is applied across the LCD cell so that the white display state is held. In this case, the capacitance of the LCD cell is Clc(white). During a time period T3, the TFT is switched to the ON state by the scanning line voltage, and the black level voltage applied on the scanning line is supplied to the LCD cell to perform a first write operation. The time period T3 is equal to one horizontal synchronization period, i.e., tens of micro seconds. As described above, the liquid crystal material itself has a response time of about 5 ms. The liquid crystal material does not respond during the time period T3 (tens of micro seconds). Although the black level voltage is applied across the LCD cell, the capacitance of the LCD cell remains Clc(white). The electric charge of the LCD cell is Qlc=(black level voltage)×Clc(white). Thereafter, during a time period T4, the TFT is switched to the OFF state. The LCD call is separated from the signal line, establishing the law of conservation of electric charge. During the time period T4, the alignment of the liquid crystal is gradually changed in accordance with the holding voltage applied across the liquid crystal. This leads to an increase in the capacitance of the LCD cell. In this case, the TFT is in the OFF state and therefore the electric charge of the LCD cell is conserved, so that the voltage of the LCD cell is decreased. As a result, despite the applied black level voltage, the voltage of the LCD cell is decreased during the time period T4, so that the LCD cell reaches only an intermediate luminance. In the next frame, at the timing of T5 the black level voltage is applied across the LCD cell again, and a second write operation is performed. At the time of the second write operation, despite the black level voltage applied across the LCD cell, the capacitance of the LCD cell is not switched to Clc(black), similar to the first write operation. For this reason, the voltage is decreased during a holding period of time T6. The above-described write operation is repeated until the LCD cell reaches the black level. In FIG. 15, for example, the black display is obtained by a third write operation in which the black level voltage is supplied again during a time period T7.

In this case, a write operation cycle of the LCD cell is equal to a frame cycle determined by the vertical synchronizing signal. Therefore, even when the black level voltage is supplied to the LCD cell in the white display state, the black display state is not obtained in the one frame cycle. Typically, three frame cycles are required to obtain the black display. A frame frequency is typically about 60 Hz (a frame cycle is equal to about 17 ms). Thus, a time required to obtain the black display is about 17 ms×3=51 ms. Therefore, the contour of a displayed image is blurred when a different image, e.g., a moving picture, is displayed for each frame.

The applicant discloses in Japanese Patent No. 1602422 a method for driving an LCD device in which a video signal is stored in a memory; the video signal is alternately supplied to a liquid crystal panel which is divided into upper and lower portions; and thus the write operation cycle is shortened. This prior technique is for the purpose of reducing a flicker of the LCD panel. On the other hand, in the present invention, applicant's attention has been captured by a change in capacitance of an LCD cell when a black display is switched to a white display or vice versa, which is a property specific to the active matrix driving LCD device. A display in response to a fast moving picture is improved using such a property.

Therefore, an object of the present invention is different from that of the prior technique. In the prior technique, the panel is divided into the upper and lower portions. The upper and lower portions of the panel are alternately driven in the following way. A first scanning line of the upper portion is driven; a first scanning line of the lower portion is then driven; a second scanning line of the upper portion is then driven; a second scanning of the lower portion is then driven; etc. In this way, the cycle of the write operation is shortened. Such a complicated driving method is not adopted in this invention.

Japanese Laid-Open Publication No. 9-265073 discloses a method for driving a nematic liquid crystal in which a voltage is repeatedly applied a number of times across a nematic liquid crystal element such as super twisted nomatic (STN) in order to improve the response speed of the nematic liquid crystal. Such a prior technique leads to a reduction in cycle of the applied voltage, which is the same feature of the present invention. However, in the prior technique, a number of ON operations are integrated. The ON operation is superior to an OFF operation in terms of an operational response, because of the relationship of ON-OFF operations (integral/differential operations), i.e., a time constant waveform has a rapidly rising edge and a slowly falling edge. In this case, an intended voltage is not obtained by a first write operation. On the other hand, even when the intended voltage is obtained in every write operation, there is a problem in that the voltage is decreased in a subsequent holding period of time. The present invention is provided to solve such a problem.

T. Kurita, "Display System for Hold Type Display and Image Quality of Moving Pictures" (Japanese Liquid Crystal Society First LCD Forum, Aug. 28, 1998), discloses a method for scanning a device using a field frequency two times or more as high as a standard frequency in which image quality of moving pictures can be improved. The present invention and the prior technique have the same feature in that a cycle of write operation is shortened. The prior technique describes that blur is prevented because pixels in a narrow spatial range are integrated by the visual system similar to the shutter effect. On the other hand, in the present invention, our attention has been captured by a change in capacitance of an LCD cell during a holding period of time after the writing of a voltage into the LCD cell, which is a phenomenon specific to the active matrix driving LCD device. Accordingly, the present invention is a technique different from the prior technique.

SUMMARY OF THE INVENTION

According to an aspect of the present invention, a device for displaying a video signal which is supplied to the device along with a vertical synchronizing signal, includes a plurality of pixels arranged in a matrix; a switching element connected to each of the plurality of pixels; and a driving circuit for writing the video signal into each of the plurality of pixels via the switching element. The driving circuit writes the video signal to each of the plurality of pixels with a cycle TW1 shorter than one cycle of the vertical synchronizing signal.

In one embodiment of this invention, the driving circuit includes a timing circuit for receiving the vertical synchronizing signal and generating a timing signal having a cycle shorter than one cycle of the vertical synchronizing signal; and a write circuit for receiving the video signal and writing the video signal into each of the plurality of pixels in accordance with the timing signal.

In one embodiment of this invention, the write circuit includes a signal line driving circuit for outputting the video signal to the switching element in accordance with the timing signal; and a scanning line driving circuit for outputting a voltage for switching the switching element to an ON or OFF state in accordance with the timing signal.

In one embodiment of this invention, the device is an active matrix liquid crystal display device. Each of the plurality of pixels has a voltage-dependent capacitance characteristic which requires N iterations of a write operation to each of the plurality of pixels. $TW1 \times N \leqq Tmov$ is satisfied where Tmov is the response limit time required for displaying a moving image without blur on the device.

According to another aspect of the present invention, a device for displaying a video signal which is supplied to the device along with a vertical synchronizing signal includes a plurality of pixels arranged in a matrix; a switching element connected to each of the plurality of pixel; and a driving circuit for writing the video signal into each of the plurality of pixels via the switching element. The driving circuit includes a switch for switching a write operation cycle for writing the video signal into each of the plurality of pixels. The switch sets the write operation cycle, in accordance with at least one parameter, to one cycle of the vertical synchronizing signal or to a cycle shorter than one cycle of the vertical synchronizing signal.

In one embodiment of this invention, the device is an active matrix liquid crystal display device. Each of the plurality of pixels has a voltage-dependent capacitance characteristic and requires N iterations of a write operation to each of the plurality of pixels. $TW1 \times N \leqq Tmov$ is satisfied where Tmov is the response limit time required for displaying a moving image without blur on the device.

In one embodiment of this invention, the at least one parameter includes one cycle of the vertical synchronizing signal.

In one embodiment of this invention, the at least one parameter includes the mode control signal input to the device.

In one embodiment of this invention, one cycle of the vertical synchronizing signal is equal to a frame or field cycle of the video signal.

According to still another aspect of the present invention, a method for use in a device for displaying a video signal which is supplied to the device along with a vertical synchronizing signal is provided. The device includes a plurality of pixels arranged in a matrix; a switching element connected to each of the plurality of pixels; and a driving circuit for writing the video signal into each of the plurality of pixels via the switching element. The method includes the steps of: receiving the vertical synchronizing signal; generating a timing signal having a cycle shorter than one cycle of the vertical synchronizing signal; receiving the video signal; and writing the video signal to each of the plurality of pixels in accordance with the timing signal.

In one embodiment of this invention, the writing step includes the steps of: driving a signal line for outputting the video signal to the switching element in accordance with the timing signal; and driving a scanning line for outputting a voltage for switching the switching element to an ON or OFF state in accordance with the timing signal.

In one embodiment of this invention, one cycle of the timing signal is substantially equal to 1/X of one cycle of the vertical synchronizing signal where X is a predetermined coefficient greater than or equal to one.

In one embodiment of this invention, the predetermined coefficient in constant.

In one embodiment of this invention, the predetermined coefficient is variable.

In one embodiment of this invention, one cycle of the timing signal is constant, being independent of the vertical synchronizing signal.

In one embodiment of this invention, one cycle of the vertical synchronizing signal is equal to a frame or field cycle of the video signal.

Hereinafter, functions of the present invention will be described.

In the present invention, an input video signal is written into each LCD cell with a cycle shorter than the cycle of a vertical synchronizing signal. Therefore, the response speed of the LCD cell can be accelerated regardless of the frame frequency of the external input video signal, thereby obtaining satisfactory moving picture display or the like. Further, the input signal may have the same signal cycle as that of the conventional devices, thereby obtaining device compatibility.

The above-described "cycle of a vertical synchronizing signal" roughly means a cycle in which a screen of a video signal is switched to another screen. In the case of a non-interlaced signal such am a computer signal, it is equal to a "frame cycle". In the case of an interlaced signal such as a television signal (e.g., a NTSC signal), it is equal to a "field cycle" (2 fields=1 frame).

For example, a black level voltage is written one time via a switching element such as a TFT into a pixel such as an LCD cell which has a voltage-dependent capacitance characteristic. The voltage of the LCD cell decreases during a holding time due to a change in the capacitance of the LCD cell. For this reason, a plurality of write operations are required to hold an intended voltage, resulting in elongation of the response time to obtain the black display. In the present invention, as described below in Examples 1–6, for the purpose of accelerating a display response, a cycle of the write operation is accelerated in such a way as to satisfy $TW1 \times N \leqq Tmov$ where TW1 is the write operation cycle for each pixel; N is the number of write operations required to hold the intended voltage during the holding time after the video signal is written; and Tmov is the response limit time required to display a moving image without blur.

When the frequency of an external vertical synchronizing signal (frame frequency or field frequency) is high, sufficient moving picture quality may be obtained even if a video signal is written into each pixel with a cycle of the vertical synchronizing signal (frame cycle or fold cycle). Therefore, as described below in Example 5, a write operation may be switched between the following two ways in accordance with the frequency of a vertical synchronizing signal (frame frequency or field frequency): (1) the video signal is written into each pixel with a cycle shorter than one cycle of the vertical synchronizing signal (frame cycle or field cycle); and (2) the video signal is written into each pixel with the same cycle as one cycle of the vertical synchronizing signal (frame cycle or field cycle). Therefore, when suspending the operation that the video signal is written into each pixel with a cycle shorter than one cycle of the vertical synchronizing signal (frame cycle or field cycle), power consumption can be lowered.

Alternatively, as described below in Example 6, the write operation may be switched between the following two ways in accordance with the input mode control signal: (1) the video signal is written into each pixel with a cycle shorter than one cycle of the vertical synchronizing signal (frame cycle or field cycle); and (2) the video signal is written into each pixel with the same cycle as one cycle of the vertical synchronizing signal (frame cycle or field cycle). In this case, operations of circuits having large power consumption, such as a frame memory and a control circuit thereof, are suspended, so that power consumption can be further lowered.

As described above, the video signal is written into each pixel with a cycle shorter than one cycle of the vertical synchronizing signal (frame cycle or field cycle). To this end, as described below in Example 2, the video signal may be written into each pixel with a cycle 1/X times one cycle of the vertical synchronizing signal (frame cycle or field cycle) where X is an arbitrary constant more than one.

Alternatively, the video signal may be written into each pixel with a cycle 1/Y times one cycle of the vertical synchronizing signal (frame cycle or field cycle) where Y is an arbitrary variable parameter more than one. In this case, the write operation of the video signal can be performed with a sufficiently short cycle in accordance with a video signal having various frame cycles.

Alternatively, the video signal may be written into each pixel with a specific cycle Z regardless of the cycle of the vertical synchronizing signal (frame cycle or field cycle). In this case, the display device can be driven with a specific optimal written operation cycle even when the input video signal has various frame cycles.

Thus, the invention described herein makes possible the advantages of providing a display device and a method for driving the display device, which can provide moving picture display having a high quality. This is achieved by preventing a reduction in a response speed which is caused by a voltage-dependent capacitance change of a display cell such as liquid crystal.

These and other advantages of the present invention will become apparent to those skilled in the art upon reading and understanding the following detailed description with reference to the accompanying figures.

DESCRIPTION OF THE PREFERRED EMBODIMENTS

Hereinafter, embodiments of the present invention will be described. Like parts may be referred to by like numerals, and such parts may not be repeatedly explained.

As described above, an LCD cell has a voltage-dependent capacitance characteristic. For this reason, one write operation of the black level voltage into the LCD cell in the white display state via the TFT does not accomplish an intended voltage. A plurality of write operations are required to hold the intended voltage so as to obtain the black display.

The number of write operations, which are required so that the voltage held by the LCD cell reaches the intended voltage, is defined as N, which may typically be 3 or 4. In other words, when the voltage applied across the LCD cell is suddenly changed, three write operation needs to be repeated.

In conventional LCD devices, the write cycle of the LCD cell is equal to a frame cycle of an video signal externally input. The response time of the LCD cell (which it takes to obtain the intended voltage) is equal to about a frame cycle×N. Assuming that N is equal to 3, since a typical video signal has a frame cycle of about 17 ms (a frame frequency of about 60 Hz), the response time Ts of the conventional LCD devices is about 17 ms×3=51 ms.

In the present invention, in order to improve the response speed of such a display device, the write cycle to the pixel is shorter than the cycle of a vertical synchronizing signal (frame cycle or field cycle).

(Example 1)

Figure 1:
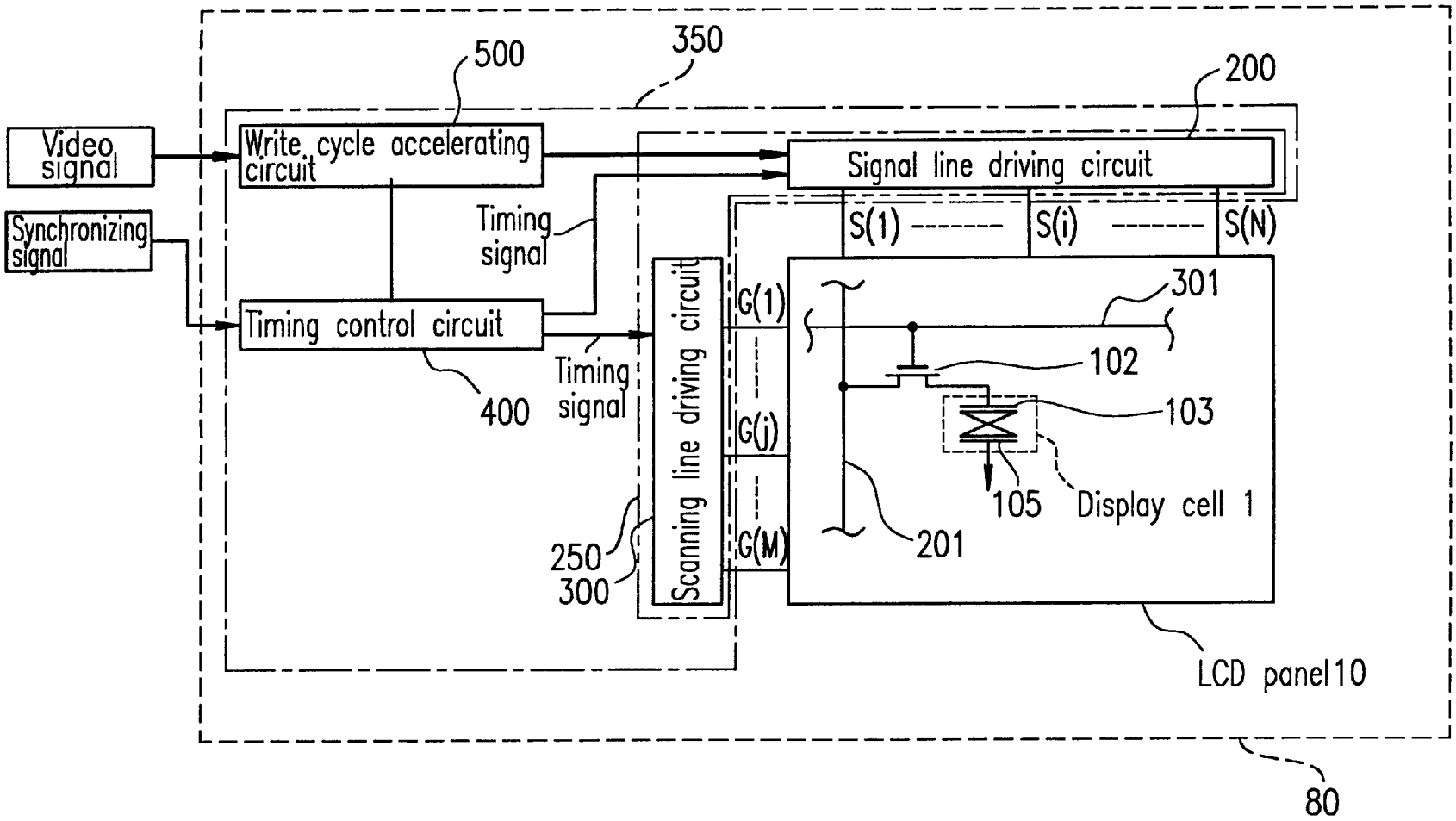
FIG. 1 is a diagram illustrating a structure of a display device according to Example 1 of the present invention.
Figure 2:
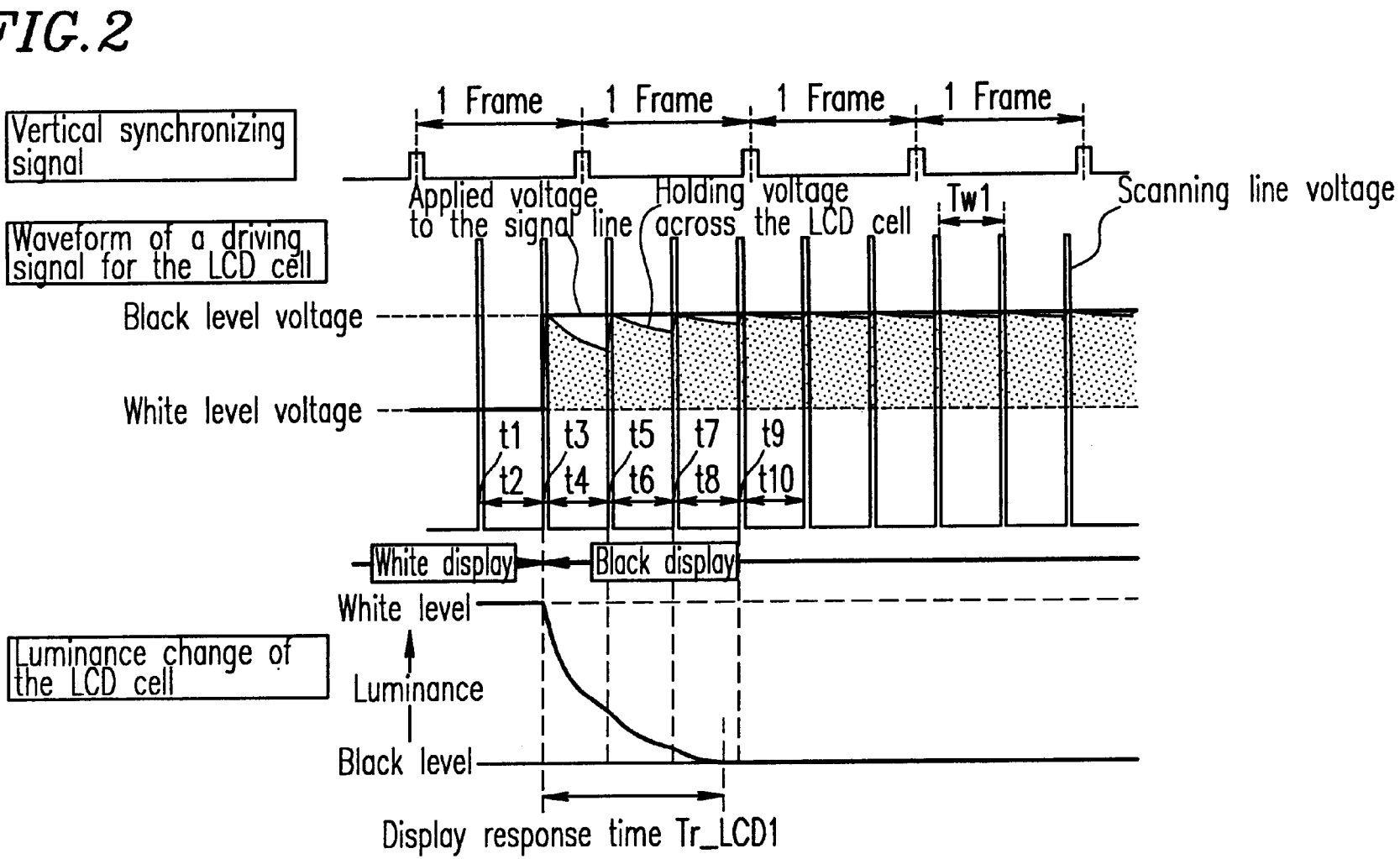
FIG. 2 is a diagram illustrating a signal waveform, a voltage change, and a luminance change in the display device of Example 1.

FIG. 1 is a diagram illustrating a structure of a display device 80 according to Example 1 of the present invention. FIG. 2 is a diagram illustrating a signal waveform and a luminance change of the display device of Example 1.

A driving circuit 350 of the display device 80 includes a write cycle accelerating circuit 500. The write cycle accelerating circuit 500 receives a video signal from the outside and propagates the video signal to a signal line driving circuit 200 with a cycle shorter than an external frame cycle. A timing control circuit 400 causes a cycle of a voltage Vgh, which is output from a scanning line driving circuit 300 to switch a TFF to the ON state, to be shorter than the external frame cycle.

In Example 1, timing of scanning is controlled by the timing control circuit 400 to accelerate the write operation cycle as shown in FIG. 1. The timing control circuit 400 may include a typical phase locked loop (PLL) circuit and a logic counter. The write cycle accelerating circuit 500 and the timing control circuit 400 cooperate with each other. The write cycle accelerating circuit 500 may be used for accelerating the scanning timing controlled by the timing control circuit 400.

Thus, the cycle of writing each LCD cell (pixel) 1 can be accelerated. For example, referring to FIG. 2, the write operation to each LCD cell 1 is performed every cycle, the cycle being TW1 (about 5 ms) which is shorter than the external frame cycle (about 16.7 ms).

During time periods t1 and t2, an LCD cell is in the white display state. During a time period t3, a black level voltage is written into the LCD cell. Similar to the conventional LCD devices, during a time period t4, the voltage of the LCD cell is decreased depending on the capacitance characteristic of the liquid crystal, so that the black display is not obtained. Thereafter, the black level voltage is repeatedly written into the LCD cell which eventually comes into the black display state (t5, t7). Assuming that the above-described required number of write operations is N=3, the display response time (Tr_LCD1) of the display device is given by (the write operation cycle to LCD cell)×(the required number of write operations)=5 ms×3=15 ms which is smaller than the moving picture response limit time Tmov (=20 ms).

Figure 3:
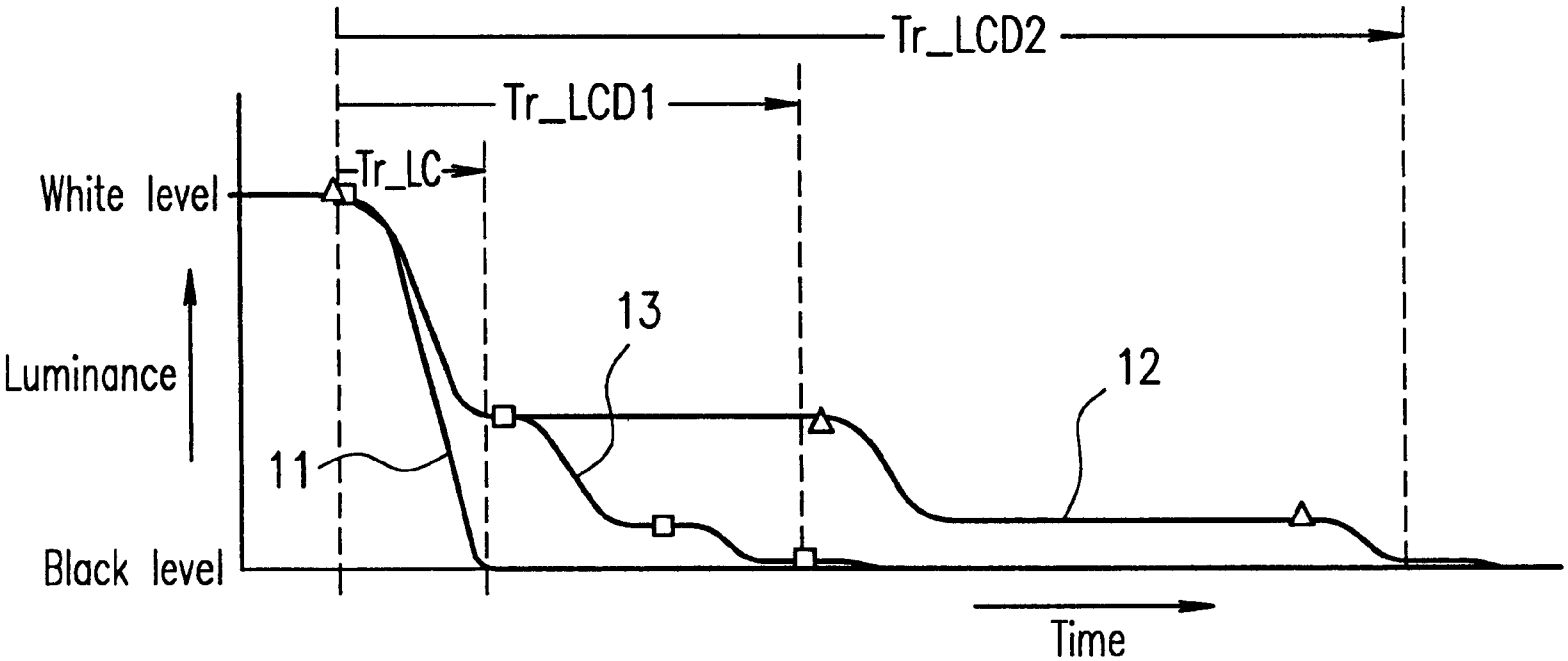
FIG. 3 is a graph illustrating a response output from a white display to a black display in the display device of Example 1 and a conventional liquid crystal display device.

FIG. 3 is a graph for comparing the display response time (Tr_LCD1) of the display device of Example 1 with the display response time (Tr_LCD2) of a conventional display device. In FIG. 3, a curve 11 indicates the response of a liquid crystal material itself. A curve 12 indicates the response of the conventional display device. A curve 13 indicates the response of the display device of Example 1.

As can be seen from FIG. 3, the response time of the display device of Example 1 is very short.

Figure 4:
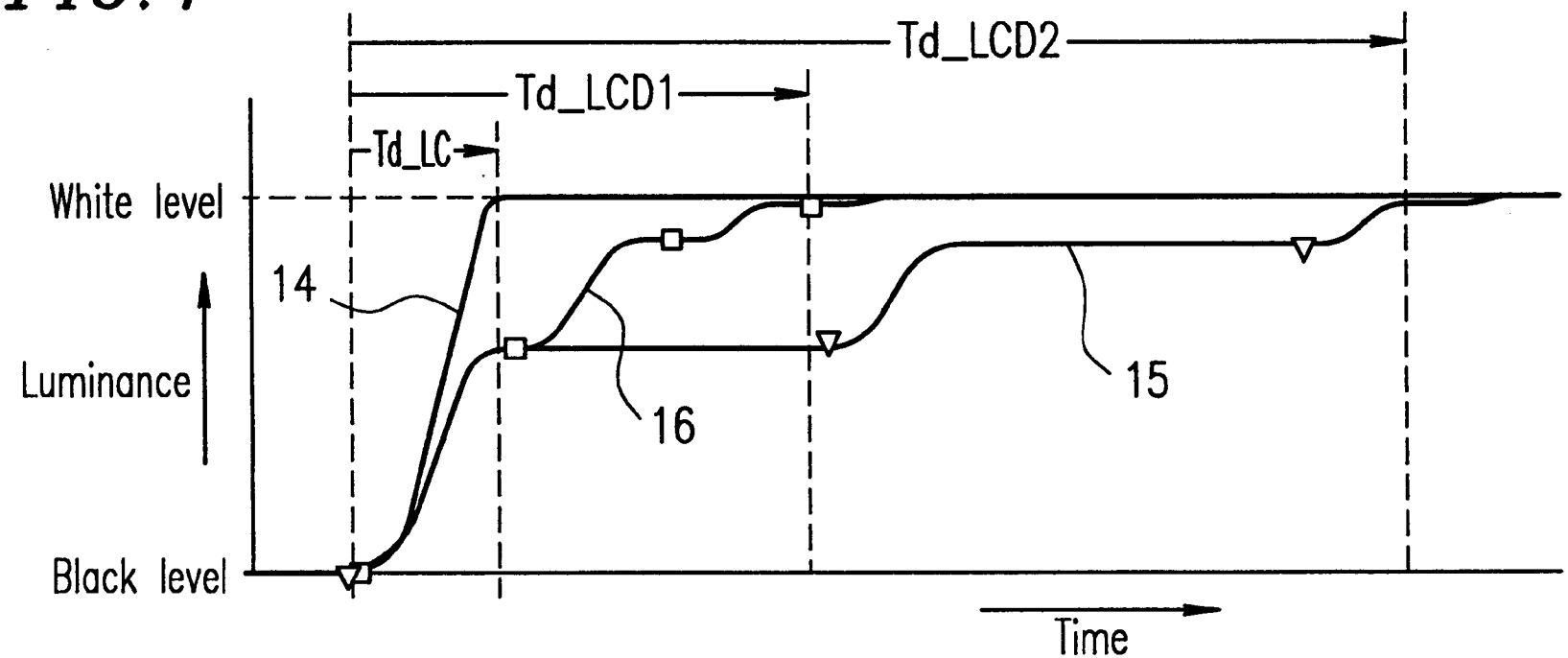
FIG. 4 is a graph illustrating a response output from the black display to the white display in the display device of Example 1 and a conventional liquid crystal display device.

FIGS. 2 and 3 show the display response from the white display to the black display. FIG. 4 shows a display response from the black display to the white display. In FIG. 4, a curve 14 indicates the response time of a liquid crystal material itself. A curve 15 indicates the response time of the conventional display device. A curve 16 indicates the response time of the display device of Example 1.

Figure 5A:
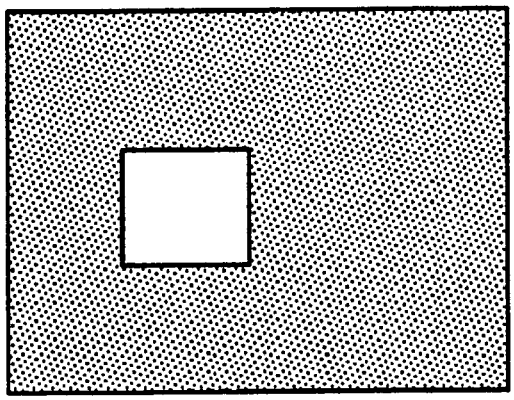
FIGS. 5A and 5B are diagrams for explaining evaluation of moving picture display in the display device of Example 1.
Figure 5B:
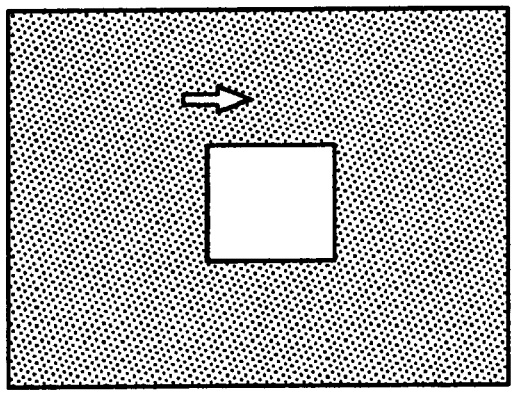

As described above, the response is improved reliably regardless of how luminance is changed. When the display device of Example 1 is subjected to a moving picture display evaluation test as shown in FIG. 5A, there occurs substantially no blur of the contour of a moving image as shown in FIG. 5B. It is thus possible to provide significantly high-quality moving picture display.

In Example 1, the write cycle accelerating circuit 500 may include a frame memory 501, an X-fold speed read control circuit 502, a variable speed read control circuit 503, a read cycle generating circuit 505, read control circuit 506, a synchronizing signal cycle determining circuit 507, a video signal switch 508, a mode control signal 510, etc., which will be described below in Examples 2 and 6 below.

(Example 2)

Figure 6:
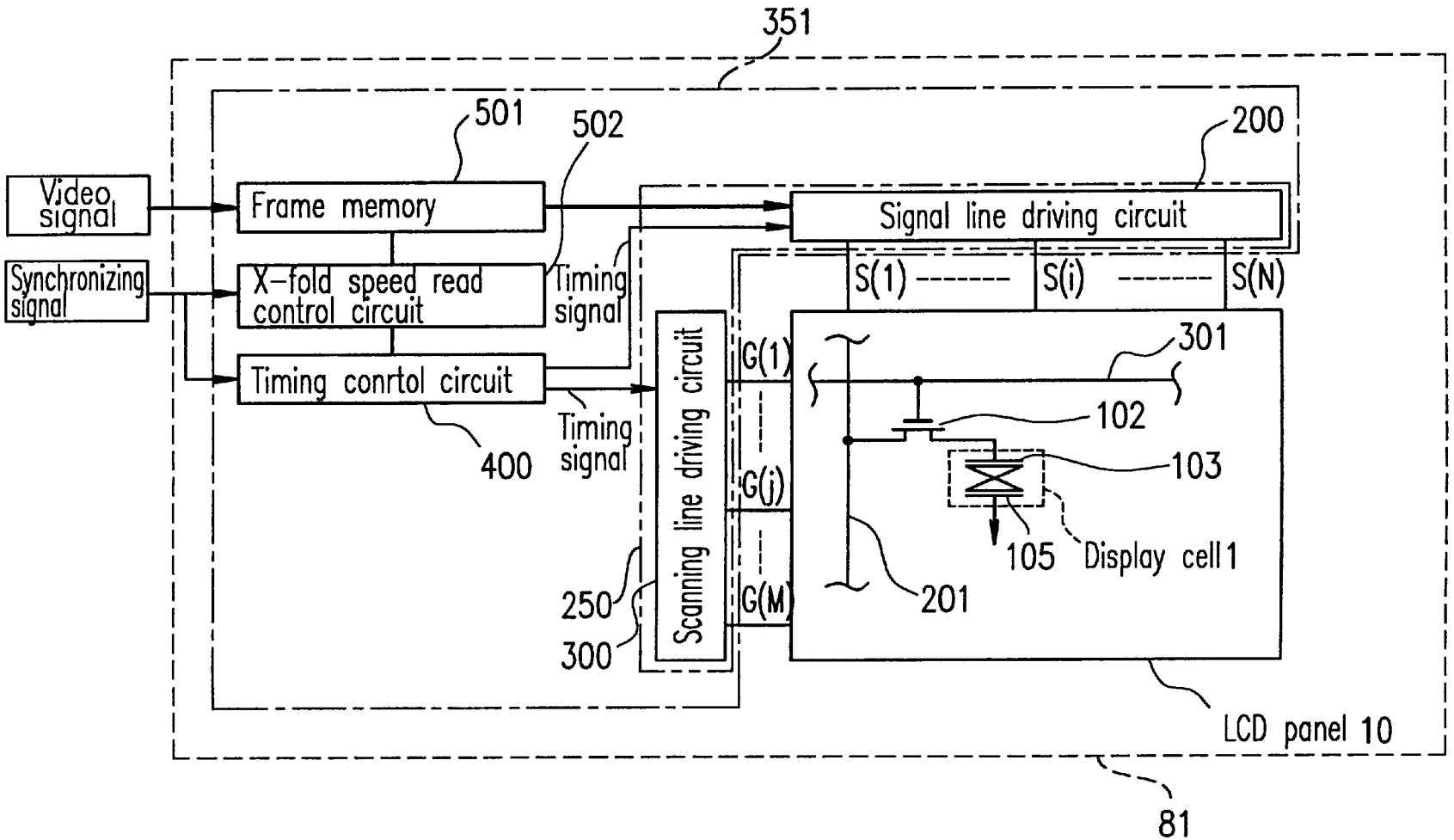
FIG. 6 is a diagram illustrating a structure of a display device according to Example 2 of the present invention.

FIG. 6 is a diagram illustrating a structure of a display device according to Example 2 of the present invention.

Referring to FIG. 6, a driving circuit 351 of a display device 81 includes the frame memory 501. The frame memory 501 stores a video signal input from the outside. The X-fold speed read control circuit 502 generates a read control signal which causes a write operation cycle for an LCD cell to be 1/X (e.g., X=3) of a frame cycle Tf of an external video signal. The video signal stored in the frame memory 501 is output to a signal line driving circuit 200 in response to the read control signal. A scanning line driving circuit 300 outputs a voltage Vgh for switching a TFT to the ON state. A timing control circuit 400 causes an output cycle of the voltage Vgh to be 1/X of the frame cycle Of of the video signal. In Example 1, the X-fold speed read control circuit 502 controls the scanning timing of the timing control circuit 400 to accelerate a write operation cycle.

In this case, the write operation cycle for the LCD call is Tf/X. The response time T_LCD of the display device is given by $$T_LCD=(Tf/X)\times(\text{the required number } N \text{ of write operations}).$$

Assuming that Tf=17 ms, X=3, and N=3, the response time of the display time T_LCD is equal to 17 ms which is shorter than the moving picture response limit time Tmov= about 20 ms. Thus, in Example 1, it is possible to achieve the display device having satisfactory high quality for moving pictures.

In Example 2, the X-fold speed read control circuit 502 may include a typical PLL circuit and the like.

(Example 3)

Recent video devices have various video formats. A frame frequency is not limited to 60 Hz. There are various video formats having different frame frequencies. When a display device receives and displays video signals of various video formats, there is a problem in that the read control is performed with a cycle which is a fixed-fold of the frame cycle of the video signal as shown in Example 2.

For example, in the case of a video format which is used in a high-quality mode of a personal computer, a video signal has a frame frequency of 130 Hz (frame cycle Tf=7.7 ms). When such a video signal is supplied to the display device of Example 2, the response time is given by $$T_LCD=(Tf/X)\times(\text{the required number N of write operations})(=7.7 \text{ ms, where } X=3 \text{ and } N=3).$$

Thus, the response time T_LCD of the display device is unnecessarily shorter than the moving picture response limit time Tmov (about 20 ms).

A time which it takes to write a voltage into an LCD cell is proportional to the write operation cycle for the LCD cell. This leads to the following problem. For example, assuming that the frame frequency is 60 Hz (frame cycle is 17 ms), the write operation frequency for an LCD call is 180 Hz (cycle is 5.6 ms), the voltage write operation time is 10 $\mu$s, and an input video signal has a frame frequency of 130 Hz (frame cycle is 7.7 ms), then the write operation frequency is 390 Hz (cycle is 2.6 ms) and the voltage write operation time for the LCD cell is 5 $\mu$s or less. As a result, the writing of a voltage into the LCD cell is not sufficient, so that display quality may be degraded.

Figure 7:
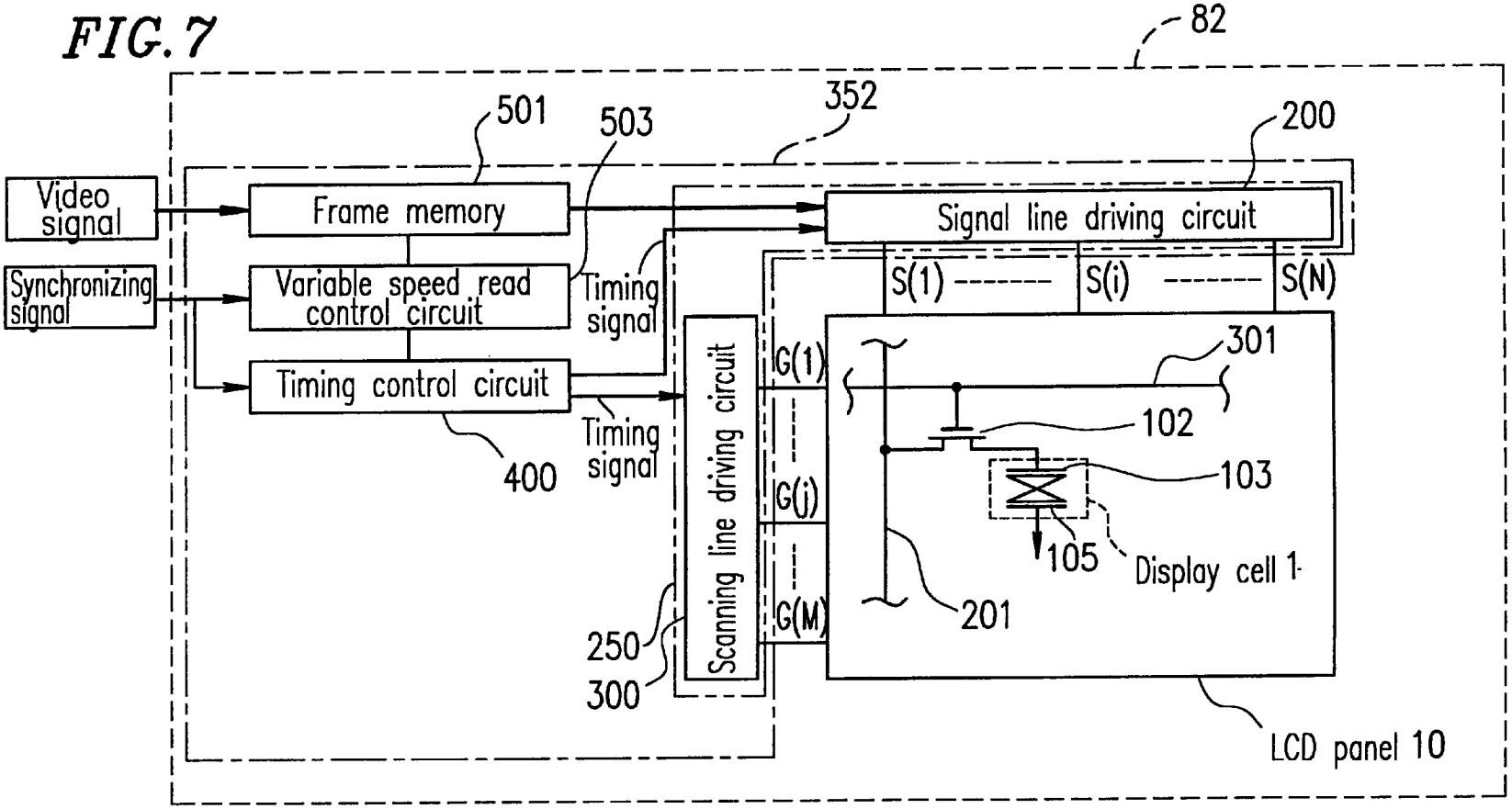
FIG. 7 is a diagram illustrating a structure of a display device according to Example 3 of the present invention.

FIG. 7 illustrates a display device 82 according to Example 3 of the present invention. A driving circuit 352 of the display device 82 include a variable speed read control circuit 503 with which a write operation cycle for an LCD cell is optimized in accordance with the frame frequency of an input video signal.

Assuming that a variable speed of the variable speed read control circuit 503 is set to X1, the response time T_LCD3 of the display device 82 is designed to satisfy the following expression (5).

$$T_LCD3=(Tf/X1)\times(\text{the required number N of write operations})\leqq(\text{the moving picture response limit time } Tmov) \quad (5)$$

The following expression (6) is obtained from expression (5).

$$X1\geqq\{Tf\times(\text{the required number N of write operations})\}/(\text{the moving picture response limit time Tmov}) \quad (6)$$

The voltage write operation time for the LCD cell can be maximized while expression (6) is satisfied, when the following expression (7) is satisfied.

$$X1=\{Tf\times(\text{the required number N of write operations})\}/(\text{the moving picture response limit time Tmov}) \quad (7)$$

For example, assuming that the frame frequency of a video signal is 130 Hz (frame cycle is 7.7 ms), the following is obtained from expression (7):

$$X1=\{7.7 \text{ ms}\times(\text{the required number N=3 of write operations})\}/(\text{the moving picture response limit time Tmov=20 ms})=1.155.$$

In this case, in Example 3, the variable speed read control circuit 503 generates a read control signal such that the write operation cycle for the LCD cell is 1/1.155 times the frame cycle of the external video signal. The video signal stored in the frame memory 501 is output to the signal driving circuit 200 using the read control signal. A scanning line driving circuit 300 outputs a voltage Vgh for switching a TFT to the ON state. A timing control circuit 400 causes an output cycle of the voltage Vgh to be 1/1.155 times the frame cycle Tf of the video signal. In Example 3, the variable speed read control circuit 503 controls the scanning timing of the timing control circuit 400 to accelerate a write operation cycle.

Thus, a moving picture can be satisfactorily displayed. Moreover, the voltage write operation time for the LCD cell is sufficient.

In Example 3, the response time of the display device is improved regardless of various video formats of video devices to provide high-quality display, and particularly satisfactory moving picture display.

In Example 3, the variable speed read control circuit 503 may include a counter, such as a typical PLL circuit, whose count number is variable.

(Example 4)

In Example 4, the response time of a display device is improved regardless of various video formats of video devices as in Example 3.

Figure 8:
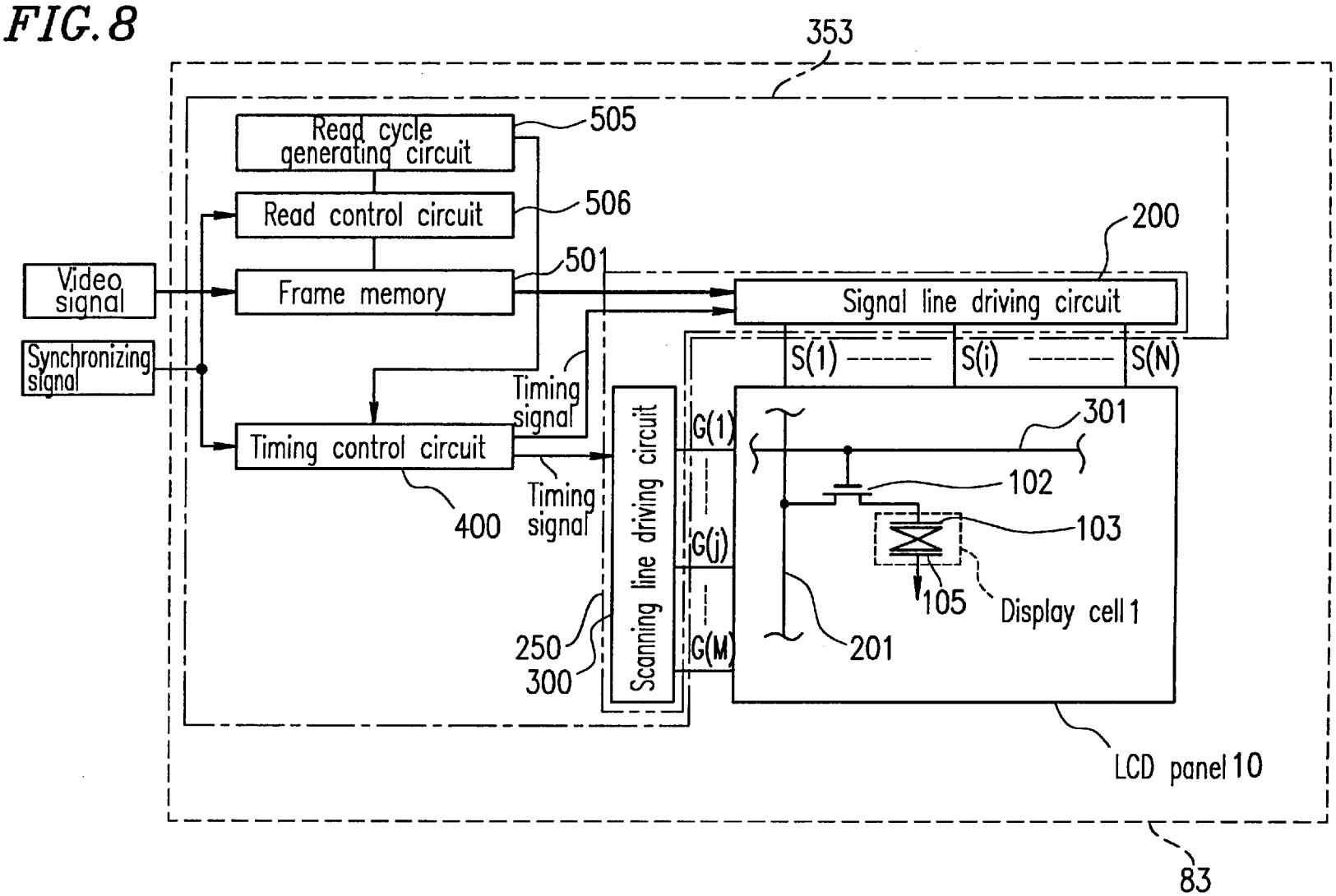
FIG. 8 is a diagram illustrating a structure of a display device according to Example 4 of the present invention.

FIG. 8 is a diagram illustrating a structure of a display device 83 according to Example 4 of the present invention.

A driving circuit 353 of the display device 83 includes a read cycle generating circuit 505 as shown in FIG. 8. With the driving circuit 353, a video signal is read regardless of an external synchronizing signal.

As described above, the response time T of the display device 83 is approximately given by T=(the write operation cycle for the LCD cell)×(the required number N of write operations).

For the purpose of obtaining satisfactory moving picture display, the following expression (8) needs to be satisfied.

T=(the write operation cycle for the LCD cell)×(the required number N of write operations)≦(the moving picture response limit time Tmov) (8)

The following expression (9) is obtained by expression (8).

(the write operation cycle for the LCD cell)≦(the moving picture response limit time Tmov)/(the required number N of write operations) (9)

The voltage write operation time for the LCD cell can be maximized, when the following expression (10) is satisfied.

(the write operation cycle for the LCD cell)=(the moving picture response limit time Tmov)/(the required number N of write operations) (10)

For example, assuming that the required number N of write operations is equal to 3, and the moving picture response limit time Tmov is equal to 20 ms, then the optimal LCD cell write operation frequency is 6.67 ms.

In Example 4, the read cycle generating circuit 505 determines a read operation cycle such that the write operation cycle for the LCD cell has the optimal value (e.g., 6.67 ms) regardless of the frame cycle of a video signal input from the outside. The read control circuit 506 generates a read control signal in accordance with the read operation cycle. A video signal stored in a frame memory 501 is output to a signal driving circuit 200 in accordance with the read control signal. A scanning line driving circuit 300 outputs a voltage Vgh for switching a TFT to the ON state. A timing control circuit 400 causes an output cycle of the voltage Vgh to be set to a value such that the write operation cycle for the LCD cell has the optimal value (e.g., 6.67 ms), regardless of the frame cycle of a synchronizing signal. In this case, the read operation cycle is determined regardless of the cycle of the synchronizing signal. The write operation time for the LCD cell is constant and stable regardless of the frame cycle of the external video signal.

As described above, in Example 4, the response time of the display device is improved regardless of various video formats of video devices to provide high-quality display, particularly satisfactory moving picture display.

In Example 4, the read cycle generating circuit 505 and the read control circuit 506 may include any constant cycle generating circuit using a crystal oscillator or the like.

(Example 5)

As described above, recent video devices have various video formats. Display devices need to display a video signal with any video format, and the optimal performance need to be obtained for each video mode. In the above-described display devices of Examples 3 and 4, the response speed is improved regardless of various video formats.

Nevertheless, when the frame frequency of a video signal input from the outside is 150 Hz (frame cycle is 6.67 ms) or the like, i.e., fast frame cycle, satisfactory moving picture display may be obtained with a conventional method for driving an LCD device.

Figure 9:
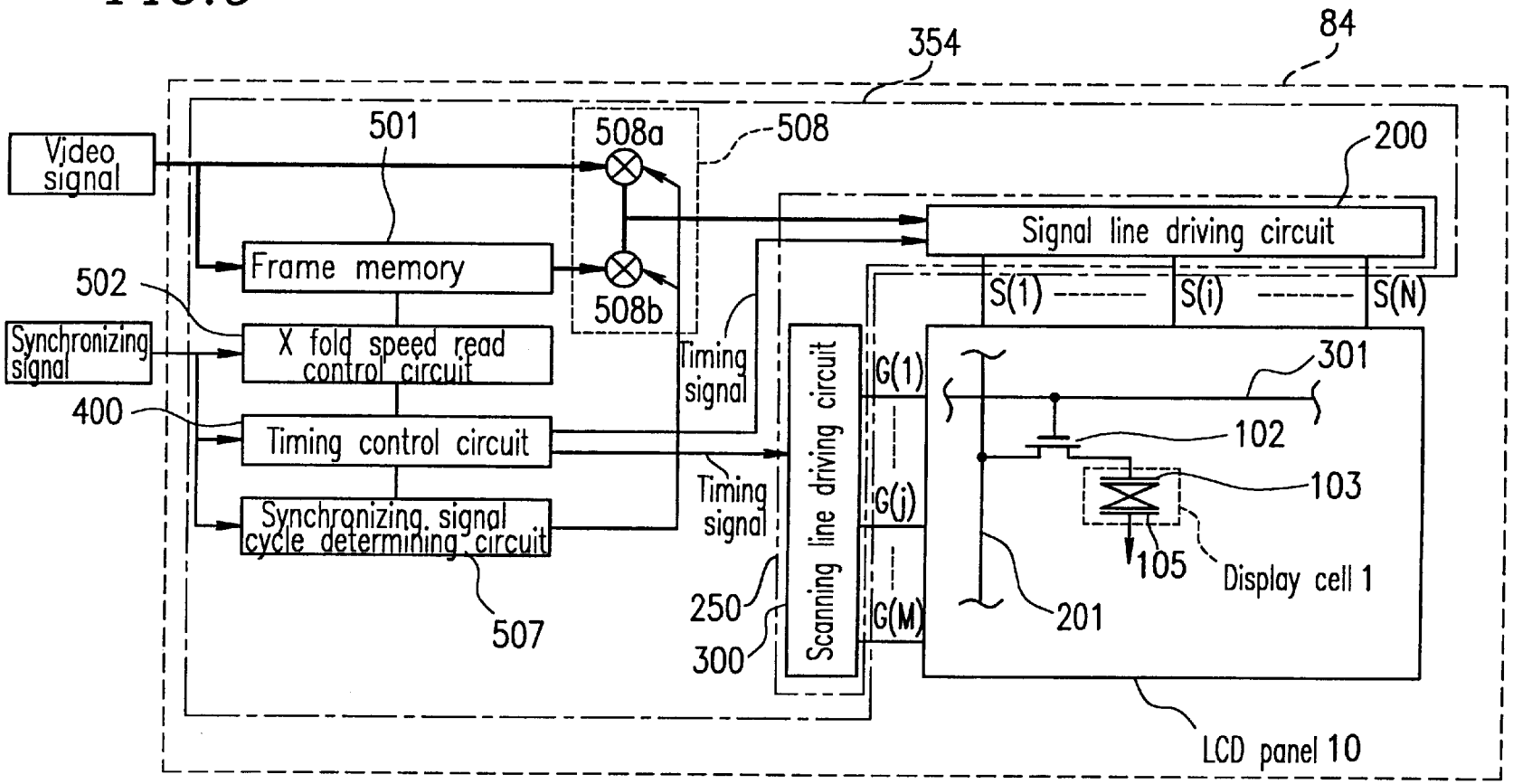
FIG. 9 is a diagram illustrating a structure of a display device according to Example 5 of the present invention.

FIG. 9 shows a display device 84 according to Example 5 of the present invention. A driving circuit 354 of the display device 54 includes a synchronizing signal cycle determining circuit 507 for determining the frame frequency of an external video signal. Further, a driving circuit 354 includes a video signal switch 508. The video signal switch 508 includes a switch 508*a* for directly outputting the external video signal to a signal line driving circuit 200 and a switch 508*b* for outputting a video signal output from a frame memory 501 to the signal line driving circuit 200.

In the above-described Example 3, the optimal operational condition is given by

X1={Tf×(the required number N of write operations)}/(the moving picture response limit time Tmov).

For example, assuming that the frame frequency of a video signal is 150 Hz (frame cycle is 6.67 ms), the following is obtained:

X1={6.67 ms×(the required number N=3 of write operations)}/(the moving picture response limit time Tmov=20 ms)=1.

Thus, a cycle of writing a video signal read out from the frame memory 501 into an LCD cell is equal to the external frame cycle.

In Example 5, when such a video signal is input, the synchronizing signal cycle determining circuit 507 determines that it is unnecessary to convert the speed of the write operation cycle for the LCD cell using the frame memory 501. Accordingly, the switch 508*b* is disconnected from and the switch 508*a* is connected to the signal line driving circuit 200. The external video signal is directly output to the signal line. A scanning line driving circuit 300 outputs a voltage Vgh for switching a TFT to the ON state. A timing control circuit 400 causes an output cycle of the voltage vgh to be equal to the frame cycle of a video signal. In this case, operations of the frame memory and a control circuit thereof can be suspended, thereby reducing power consumption.

On the other hand, when the synchronizing signal cycle determining circuit 507 determines that it is necessary to convert the speed of the write operation cycle for the LCD cell, the switch 508*a* is disconnected from and the switch 508*b* is connected to the signal line driving circuit 200. Image data stored in the frame memory 501 is output to the signal line driving circuit 200 with a frequency shorter than the frame cycle of an input video signal. A scanning line driving circuit 300 outputs a voltage Vgh for switching a TFT to the ON state. A timing control circuit 400 causes an output cycle of the voltage Vgh to be shorter than the frame cycle of a video signal, as in Examples 2 and 4.

In Example 5, when it is determined that the speed conversion of the write operation cycle is not necessary, the timing control circuit 400 may be switched by the synchronizing signal cycle determining circuit 507. Alternatively, instead of such a switch operation, X may be set to 1.

In Example 5, the synchronizing signal cycle determining circuit 507 may include a typical frequency counter.

Example 5, although the X-fold speed read control circuit 502 similar to that of Example 2 is used, a variable speed read control circuit 503 similar to that of Example 3, or a read cycle generating circuit 505 and the read control circuit 506 similar to those of Example 4 may be used.

(Example 6)

Recently, mobile notebook personal computers have had significantly improved performance. In some cases, moving picture display is often performed. In the above-described Examples, circuits consuming a large amount of power, such as a frame memory, operate regardless of whether contents to be displayed are moving pictures or still pictures. This leads to a reduction in battery duration in mobile devices such as the notebook personal computer. In Example 6, a display device capable of switching between moving picture display and still picture display will be described.

Figure 10:
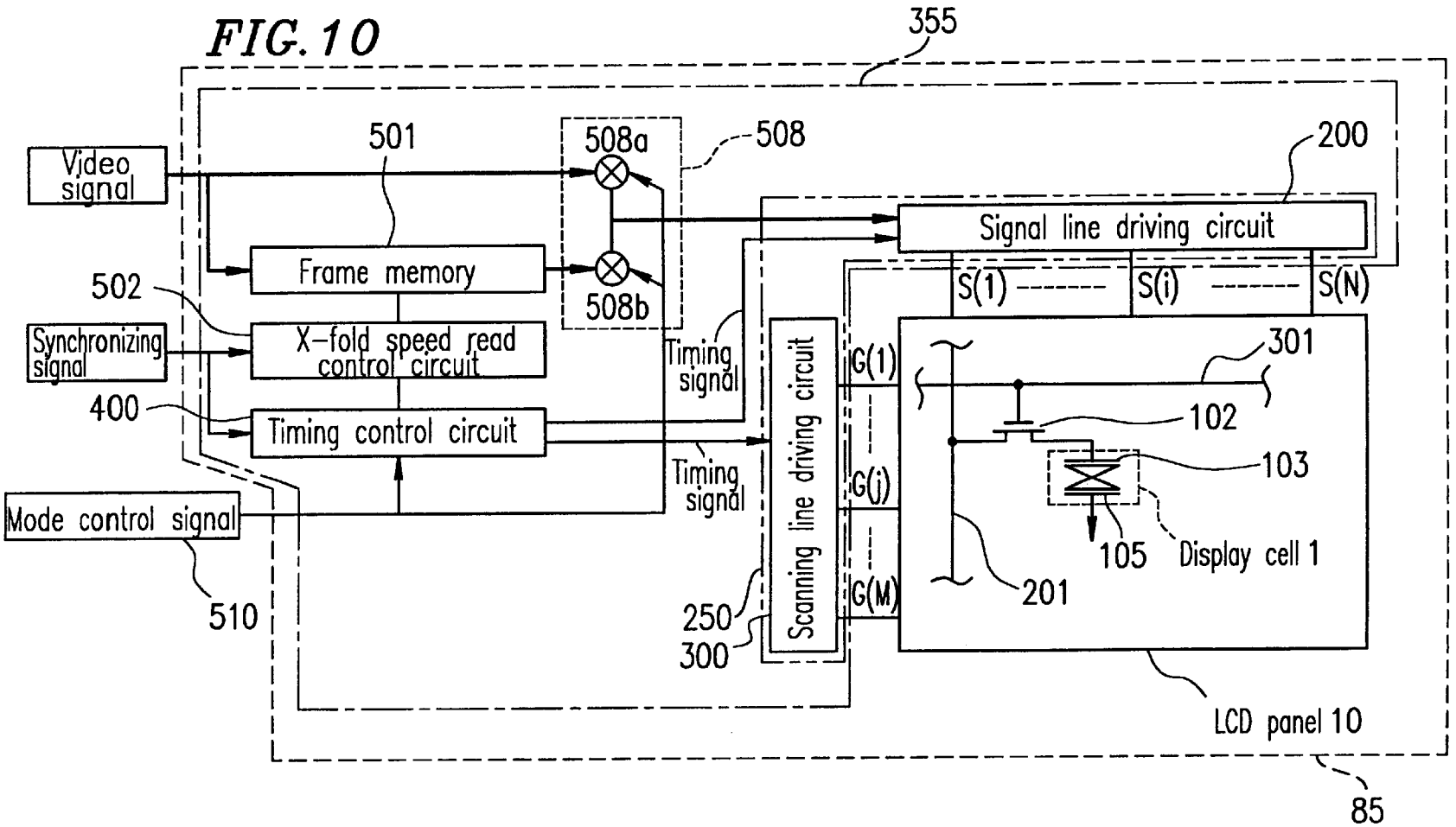
FIG. 10 is a diagram illustrating a structure of a display device according to Example 6 of the present invention.
Figure 11:
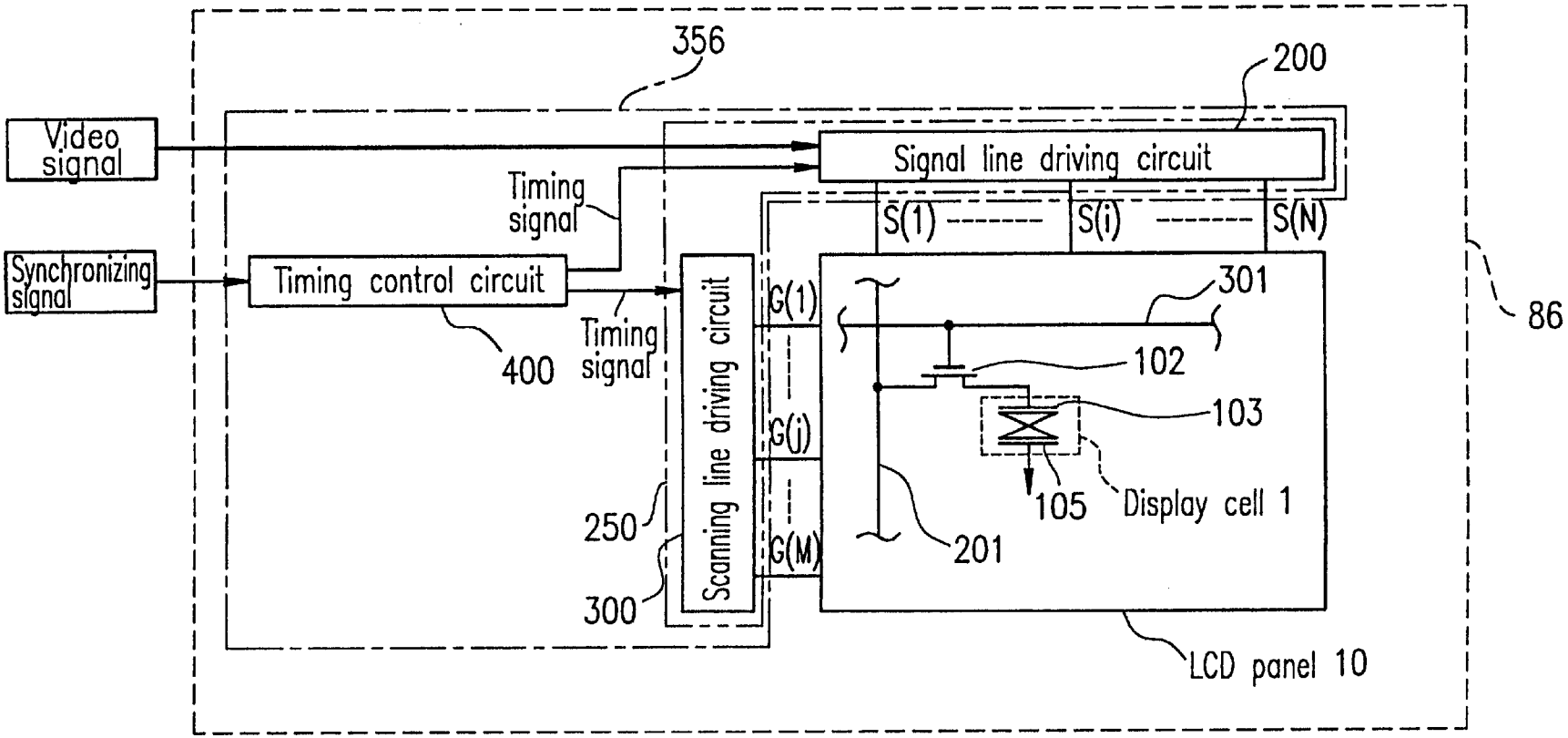
FIG. 11 PRIOR ART
FIG. 11 is a diagram illustrating a structure of a conventional liquid crystal display device.
Figure 12A:
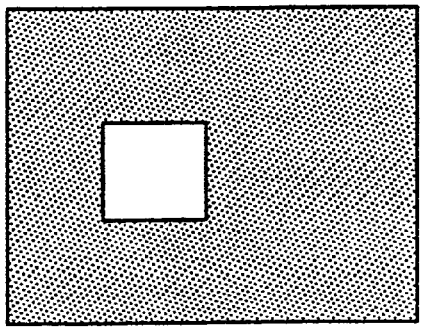
FIG. 12A PRIOR ART
FIGS. 12A and 12B are diagrams for explaining evaluation of moving picture display in the conventional liquid crystal display device.
Figure 12B:
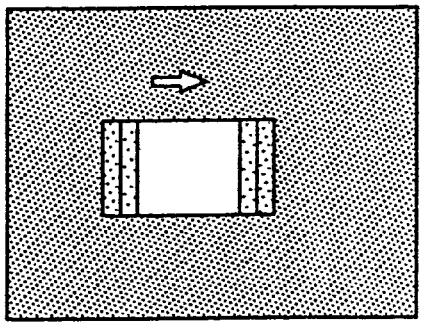
FIG. 12B PRIOR ART
Figure 13A:
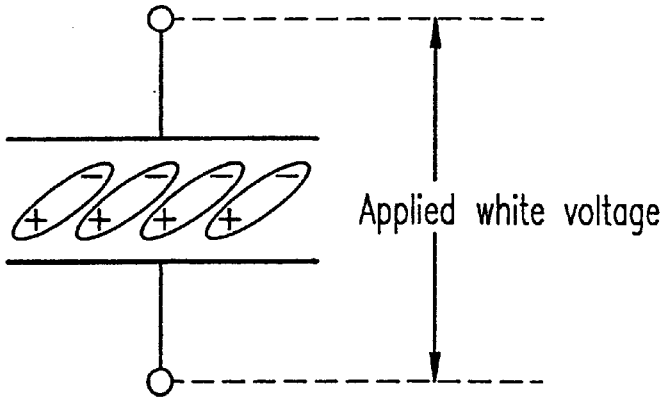
FIG. 13A PRIOR ART
FIG. 13A is a diagram illustrating an LCD cell in a white display state in the presence of an applied white level voltage.
Figure 13B:
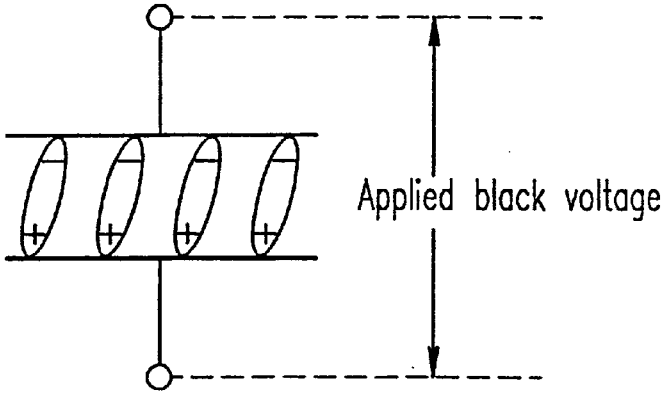
FIG. 13B PRIOR ART
FIG. 13B is a diagram illustrating an LCD cell in a black display state in the presence of an applied black level voltage.
Figure 14:
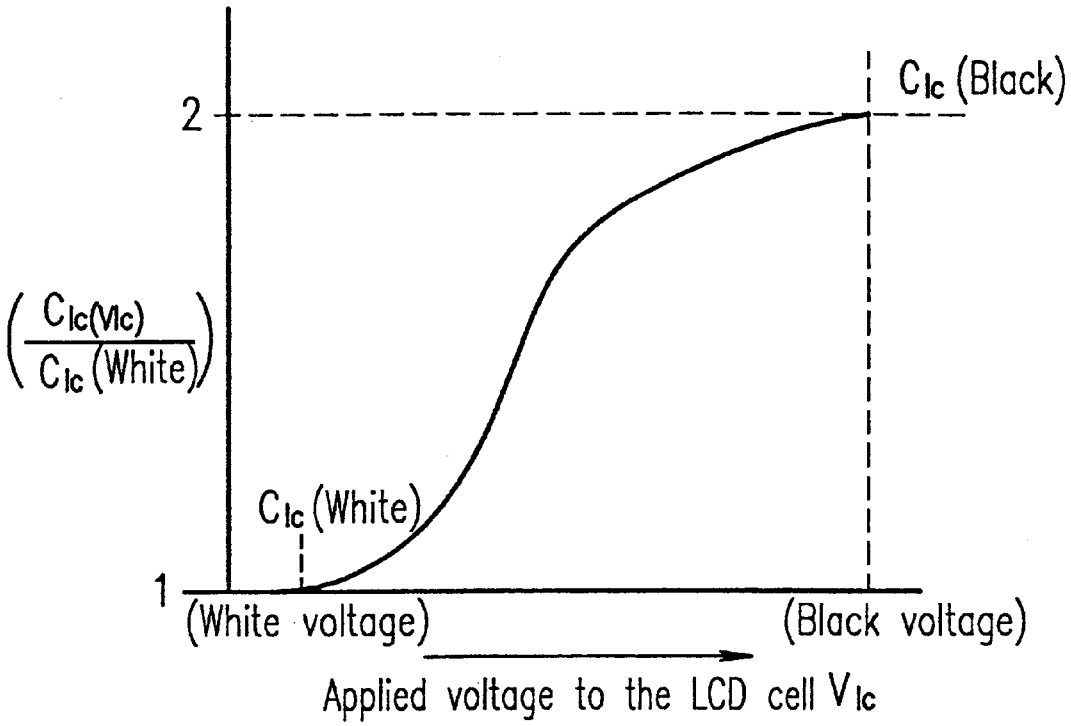
FIG. 14 PRIOR ART
FIG. 14 is a diagram illustrating the voltage-dependent capacitance characteristic of an LCD cell.
Figure 15:
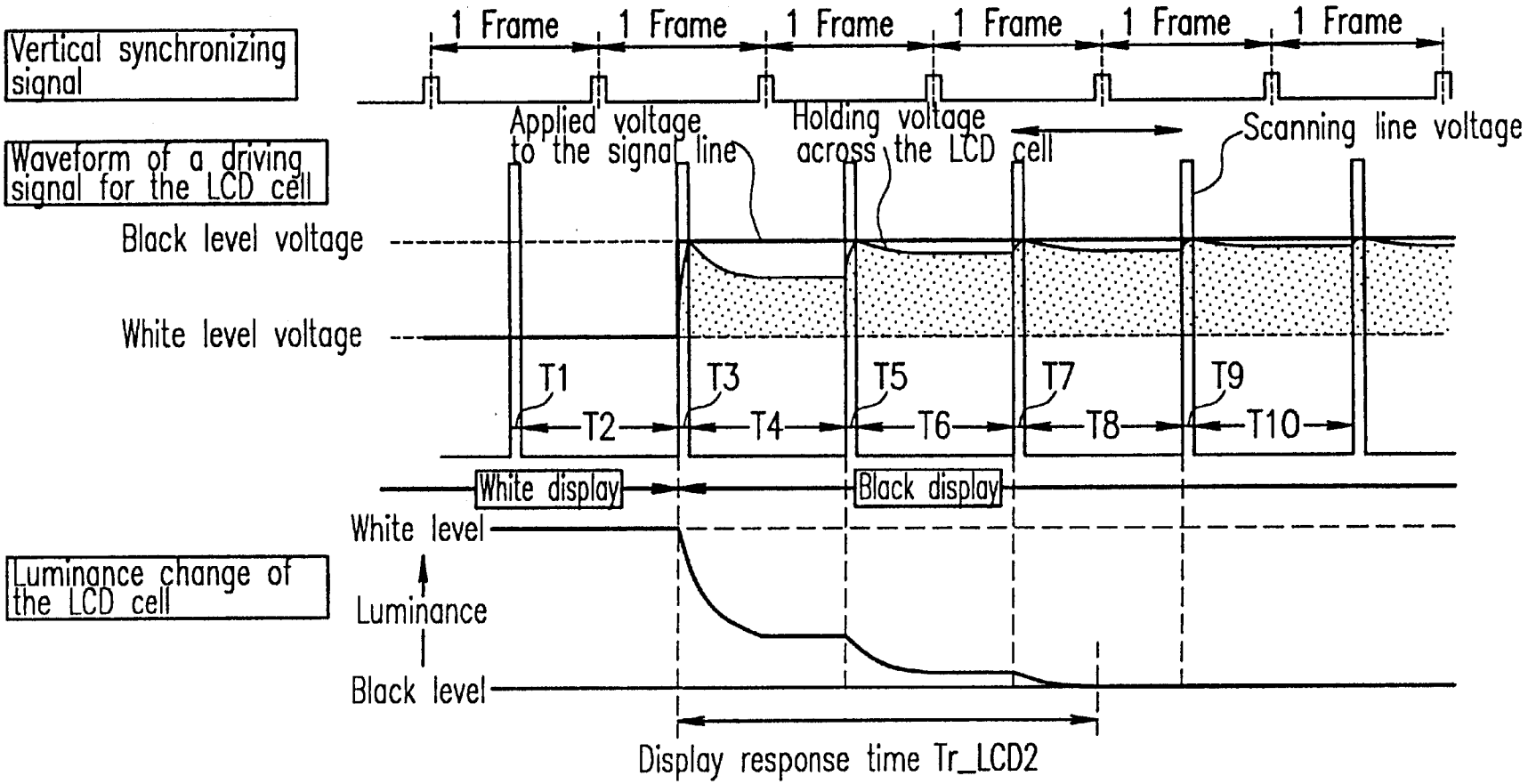
FIG. 15 PRIOR ART
FIG. 15 is a diagram illustrating a signal waveform, a voltage change, and a luminance change in the conventional liquid crystal display device.

FIG. 10 is a diagram illustrating a structure of a display device 85 according to Example 6 of the present invention.

A mode control signal 510 is supplied to a driving circuit 355 of the display device 85 from the outside. For example, the mode control signal 510 includes a value "H" indicating that the display device 85 is controlled in a moving picture display mode and a value "L" indicating that the display device 85 is in a still picture display mode.

In the moving picture display mode, the value "H" is supplied as the mode control signal 510 to the driving circuit 355. In this case, as in Examples 2 and 4, an input video signal is stored in the frame memory 501; a switch 508*a* is disconnected from and a switch 508*b* is connected to a signal line driving circuit 200 so that the stored video signal is output to a signal line driving circuit 200. Accordingly, a write operation cycle for an LCD cell is shortened, whereby substantially no problem arises when displaying moving pictures or the like. A scanning line driving circuit 300 outputs a voltage Vgh for switching a TFT to the ON state. A timing control circuit 400 causes an output cycle of the voltage Vgh to be shorter than the frame cycle of a video signal, as in Examples 2 and 4. At the same time, the timing control circuit 400 is switched by the mode control signal 510 from a normal timing mode to an X-fold timing mode.

On the other hand, in the still picture mode, the value "L" is supplied as the mode control signal 510 to the driving circuit 355. The switch 508*b* is disconnected from and the switch 508*a* is connected to the signal line driving circuit 200. The external video signal is directly output to the signal line driving circuit 200. The scanning line driving circuit 300 outputs a voltage Vgh for switching a TFT to the ON state. The timing control circuit 400 causes the cycle of the outputting the voltage Vgh to be equal to the frame cycle of a video signal. Thus, the frame memory and the control circuit thereof consuming a large power can be suspended, thereby reducing power consumption.

As described above, in Example 6, the response speed is improved in the moving picture made, so that satisfactory high-quality display can be obtained for quick response display. Moreover, power consumption can be reduced, which is advantageous to mobile devices.

In Example 6, although the X-fold speed read control circuit 502 similar to that of Example 2 is used, a variable speed read control circuit 503 similar to that of Example 3, or a read cycle generating circuit 505 and the read control circuit 506 similar to those of Example 4 may be used.

In Examples 1 to 6, the theoretical expressions do not include the response speed of a liquid crystal material. This is because the expressions are approximate expressions when the response speed of a display device due to the voltage-dependent capacitance characteristic of the liquid crystal material is dominant. For some liquid crystal materials, the response speed of the liquid crystal materials may be taken into consideration in the above-described theoretical expressions.

Further, in Examples 1 to 6, a video signal input from the outside is propagated into the signal line driving circuit 200 with a cycle shorter than the frame cycle of the video signal. The scanning line driving circuit 300 outputs a voltage Vgh for switching a TFT to the ON state. The timing control circuit 400 causes the cycle of the outputting the voltage Vgh to be shorter than the frame cycle of the video signal. The write operation for the LCD cell 1 is performed with the cycle shorter than one frame cycle. The present invention can be applied to the case when a frame of a video signal such as a TV signal is composed of two fields. In this case, an external input video signal is propagated into the signal line driving circuit 200 with a cycle shorter than one cycle of a vertical synchronizing signal (field cycle) from the outside. The timing control circuit 400 causes the cycle of the outputting the voltage Vgh to be shorter than one cycle of the vertical synchronizing signal. The write operation for the LCD cell 1 is thus performed with the cycle shorter than one frame cycle. In other words, except that the write operation cycle is shorter than one cycle of the vertical synchronizing signal instead of reference to the frame cycle, the circuit structure and operation are the same as those in Examples 1 and 6, but the response time of the display device can be improved.

Further, as a method for alternately driving an LCD device, there are various methods, such as a frame inverting drive in which the polarity of a signal line is changed for each frame, a line inverting drive in which the polarity of a signal line is changed for each horizontal signal, and a dot inverting drive in which the polarity of a signal line is changed for each pixel. The present invention is independent of those driving methods. The present invention is effective in each method.

In the above-described Examples, the white display (transmission) is obtained in the absence of an applied voltage, while the black display (non-transmission) is obtained in the presence of an applied voltage (i.e. normally white mode). The present invention can be applied to the case of the normally black mode, i.e., the black display (transmission) is obtained in the absence of an applied voltage, while the white display (non-transmission) is obtained in the presence of an applied voltage.

Further, as a structure of a display panel, a structure including a TFT array substrate and a counter substrate, an in-plane switching (IPS) structure including a glass substrate on which comb-shaped electrodes are alternately provided and a counter glass substrate, and the like are known. The present invention is independent of the structure of the display panel. The present invention is effective for each display panel.

As described above, the display devices, such as LCD display devices, include a pixel having a voltage-dependent capacitance characteristic because of a property of a material thereof. When such display devices are driving by a method in which a video signal is written into the pixel via a switching element, the response time is reduced. According to the present invention, the video signal is written with a cycle shorter than one cycle of a vertical synchronizing signal (frame cycle or field cycle), thereby preventing such a problem. Therefore, the contour of an image is not blurred in quick response display such as moving picture display, thereby obtaining a high display-quality display device. The effects obtained by the present invention are extremely significant.

According to the present invention, the cycle of writing a video signal is set to 1/Y (Y is an arbitrary variable value) of one cycle of the vertical synchronizing signal (frame cycle or field cycle), or a specific cycle Z in no connection with one cycle of the vertical synchronizing signal (frame cycle or field cycle). Therefore, the response speed of the display device can be optimized in accordance with various video formats of video devices, thereby providing a display device having high-quality display, and particularly satisfactory moving picture display.

According to the present invention, a write operation can be switched between the following two ways: (1) a video signal is written into each pixel with a cycle shorter than one cycle of a vertical synchronizing signal (frame cycle or field cycle) of a video signal input from the outside in accordance with one cycle of the vertical synchronizing signal (frame cycle or field cycle) or a mode control signal input from the outside; and (2) a video signal is written into each pixel with the same cycle as one cycle of the vertical synchronizing signal (frame cycle or field cycle). Therefore, a display device having high-quality display, particularly satisfactory moving picture display, can be obtained. Moreover, power consumption can be reduced in accordance with input video signals.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A device for displaying a video signal which is supplied to the device along with a vertical synchronizing signal, the vertical synchronizing signal corresponding to an external frame cycle for driving a display panel, the device comprising:

a plurality of pixels arranged in a matrix;

a switching element connected to each of the plurality of pixels;

a driving circuit for writing the video signal into each of the plurality of pixels via the switching element; and a write cycle accelerating circuit for receiving the video signal from outside the device and propagating the video signal to the driving circuit with a cycle time shorter than a cycle time of the vertical synchronizing circuit, wherein the driving circuit writes the video signal to each of the plurality of pixels with a the cycle time shorter than the cycle time of the vertical synchronizing signal.

2. A device according to claim 1, wherein the driving circuit comprises:

a timing control circuit for receiving the vertical synchronizing signal and generating a timing signal having a cycle time shorter than the cycle time of the vertical synchronizing signal; and a write circuit for receiving the video signal and writing the video signal into each of the plurality of pixels in accordance with the timing signal.

3. A device according to claim 2, wherein the write circuit comprises:

a signal line driving circuit for outputting the video signal to the switching element in accordance with the timing signal; and a scanning line driving circuit for outputting a voltage for switching the switching element to an ON or OFF state in accordance with the timing signal.

4. A device according to claim 1, wherein the device is an active matrix liquid crystal display device;

each of the plurality of pixels has a voltage-dependent capacitance characteristic which requires N iterations of a write operation to each of the plurality of pixels; and $TW1 \times N \leqq Tmov$ is satisfied where Tmov is the response limit time required for displaying a moving image without blur on the device.

5. A device for displaying a video signal which is supplied to the device along with a vertical synchronizing signal, the vertical synchronizing signal corresponding to an external frame cycle for driving a display panel, the device comprising:

a plurality of pixels arranged in a matrix;

a switching element connected to each of the plurality of pixels;

a driving circuit for writing the video signal into each of the plurality of pixels via the switching element; and a write cycle accelerating circuit for receiving the video signal from outside the device and propagating the video signal to the driving circuit with a cycle time shorter than a cycle time of the vertical synchronizing circuit, wherein the driving circuit comprises a switch for switching a write operation cycle for writing the video signal into each of the plurality of pixels; and the switch sets the write operation cycle, in accordance with at least one parameter, to the cycle time shorter than the cycle time of the vertical synchronizing signal.

6. A device according to claim 5, wherein the device is an active matrix liquid crystal display device;

each of the plurality of pixels has a voltage-dependent capacitance characteristic which requires N iterations of a write operation to each of the plurality of pixels; and $TW1 \times N \leqq Tmov$ is satisfied where Tmov is the response limit time required for displaying a moving image without blur on the device.

7. A device according to claim 5, wherein the at least one parameter includes one cycle of the vertical synchronizing signal.

8. A device according to claim 5, wherein the at least one parameter includes the mode control signal input to the device.

9. A device according to claim 5, wherein one cycle of the vertical synchronizing signal is equal to a frame or field cycle of the video signal.

10. A method for use in a device for displaying a video signal which is supplied to the device along with a vertical synchronizing signal, the vertical synchronizing signal corresponding to an external frame cycle for driving a display panel, the device comprising:

a plurality of pixels arranged in a matrix;

a switching element connected to each of the plurality of pixels;

a driving circuit for writing the video signal into each of the plurality of pixels via the switching element; and a write cycle accelerating circuit for receiving the video signal from outside the device and propagating the video signal to the driving circuit with a cycle time shorter than a cycle time of the vertical synchronizing circuit, the method comprising the steps of:

receiving the vertical synchronizing signal;

generating a timing signal having the cycle time shorter than the cycle time of the vertical synchronizing signal;

receiving the video signal; and writing the video signal to each of the plurality of pixels in accordance with the timing signal.

11. A method according to claim 10, wherein the writing step comprises the steps of:

driving a signal line for outputting the video signal to the switching element in accordance with the timing signal; and driving a scanning line for outputting a voltage for switching the switching element to an ON or OFF state in accordance with the timing signal.

12. A method according to claim 10, wherein one cycle of the timing signal is substantially equal to 1/X of one cycle of the vertical synchronizing signal where X is a predetermined coefficient greater than one.

13. A method according to claim 12, wherein the predetermined coefficient is constant.

14. A method according to claim 12, wherein the predetermined coefficient is variable.

15. A method according to claim 10, wherein one cycle of the timing signal is constant, being independent of the vertical synchronizing signal.

16. A method according to claim 10, wherein one cycle of the vertical synchronizing signal is equal to a frame or field cycle of the video signal.

* * * * *